US007124512B2

(12) United States Patent
Forrest

(10) Patent No.: US 7,124,512 B2
(45) Date of Patent: Oct. 24, 2006

(54) ARCHERY BOW SIGHT

(76) Inventor: Richard Forrest, 11895 E. Camino Aurelia, Tucson, AZ (US) 85641

( * ) Notice: Subject to any disclaimer, the term of this patent is extended or adjusted under 35 U.S.C. 154(b) by 0 days.

(21) Appl. No.: 11/035,629

(22) Filed: Jan. 14, 2005

(65) Prior Publication Data

US 2006/0156559 A1 Jul. 20, 2006

(51) Int. Cl.
*F41G 1/00* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | | |
|---|---|---|---|---|---|
| 3,310,875 | A * | 3/1967 | Kowalski | 33/265 |
| 3,579,839 | A * | 5/1971 | Kowalski | 33/265 |
| 4,020,560 | A * | 5/1977 | Heck | 33/265 |
| 4,136,462 | A * | 1/1979 | Topel | 33/265 |
| 4,481,717 | A * | 11/1984 | Kowalski | 33/265 |
| 4,532,717 | A * | 8/1985 | Watson et al. | 33/265 |
| 4,535,747 | A * | 8/1985 | Kudlacek | 124/87 |
| 4,543,728 | A * | 10/1985 | Kowalski | 33/265 |
| 4,635,374 | A * | 1/1987 | Bradshaw | 33/265 |
| 4,910,874 | A * | 3/1990 | Busch | 33/265 |
| 5,228,204 | A * | 7/1993 | Khoshnood | 33/265 |
| 5,406,712 | A * | 4/1995 | Slates | 33/265 |
| 2003/0208916 | A1 * | 11/2003 | Rager | 33/265 |

* cited by examiner

*Primary Examiner*—G. Bradley Bennett
*Assistant Examiner*—Travis Reis
(74) *Attorney, Agent, or Firm*—Mark Ogram

(57) ABSTRACT

An archery combination involving an archery bow and a bow sight. The bow sight uses a brace secured to the bow with at least two sighting pins which extend at right angles to the archer's line of sighting. A protective guard is secured to the brace and, is moveable between a protective position around the sighting pins to a position which exposes the pins. When the protective guard is in position to expose the sighting pins, the pins are released or "unlocked" from the brace allowing the sighting pins to be easily removed from the brace for repositioning; when the protective guard is in the protective position, the pins are "locked" and cannot be removed from the bow sight.

11 Claims, 4 Drawing Sheets

ARCHERY BOW SIGHT

BACKGROUND OF THE INVENTION

This invention relates generally to archery equipment and more particularly to archery bow sights.

The modern competitive archery bow bears little resemblance to the bows of the middle ages. Composite materials are now used instead of birch wood; extreme balance is established and maintained through adjustable counter balances instead of relying on the carving skills of the bowmaker; and, complex and adjustable sights providing for differing ranges are now used instead of sighting along the arrow.

Competitive archery has developed in an extraordinary way and most of this progress has occurred in the last fifty years. Perhaps the most dramatic development relating to archery has been the sighting mechanisms themselves.

These sighting mechanisms originally were crude mechanisms, not much more than markings made on tape along the bow itself; and now include sights which allow the archer to not only adjust for the range, but also to provide sighting pins which extend into the archer's natural line of sighting to create a comfortable shooting experience.

One such archery bow sight is described in U.S. Pat. No. 4,984,373, issued on Jan. 15, 1991, to Forrest and entitled, "Archery Bow Sight", incorporated hereinto by reference.

Within the Forrest patent, each sighting pin is removable and can be placed within any of a variety of pin holes, allowing the pins to be placed to meet the specific archer's requirements. The pins though are left exposed, allowing them to be bent during normal use. Once properly positioned, the pins are "locked" into the bow sight to keep them from being jarred or mis-aligned.

It is clear there is a need for improved archery sights.

SUMMARY OF THE INVENTION

The invention relates to an archery combination involving an archery bow and a bow sight. Within this context, the bow sight of this invention is also useful for other types of weapons such as cross bows.

The bow sight of this invention uses a brace which is secured to a bow. As discussed relative to U.S. Pat. No. 4,984,373, which has been incorporated hereinto by reference, the bow sight uses at least two sighting pins which extend at right angles to the archer's line of sighting. These sighting pins arc placed within the mechanism to provide the individual archer with optimal sighting points.

The sighting pins are inserted into holes within the bow sight and are then secured by a compression mechanism which frictionally secures the sighting pins within the bow sight. The compression mechanism is selectively engaged by the archer, thereby allowing individual pins to be "loosened"/"unlocked", removed, and placed in a new location to provide a "more accurate" sighting pin point for the archer.

By allowing the sight to have multiple pins, the archer is able to address a variety of sighting pins to assist with the most common distances encountered.

A protective guard is secured to the brace and is moveable between a protective position around the sighting pins to a position which exposes the pins. Because the sighting pins extend at right angles to the archer's line of sighting, the guard, when in a protective position, extends at right angles to the line of sighting of the archer as well. When the guard is in this position, the line of sight for the archer is through the protective guard.

Movement of the guard is accomplished by manually moving the guard away from its "locked" position perpendicular to the line of sight, to an "unlocked" position parallel to the line of sight.

When the protective guard is in position to expose the sighting pins ("unlocked"), the sighting pins are released from the brace allowing the sighting pins to be easily removed from the brace for either repositioning or complete removal. In this manner, the protective guard serves the purpose of both giving protection to the "locked" sighting pins and also allowing the sighting pins to be "unlocked" so that the sighting pins can be removed or altered to fit the needs of the archer.

The invention, together with various embodiments thereof, will be more fully explained by the accompanying drawings and the following descriptions thereof.

DRAWINGS IN BRIEF

DRAWINGS IN DETAIL

Figure 1A:
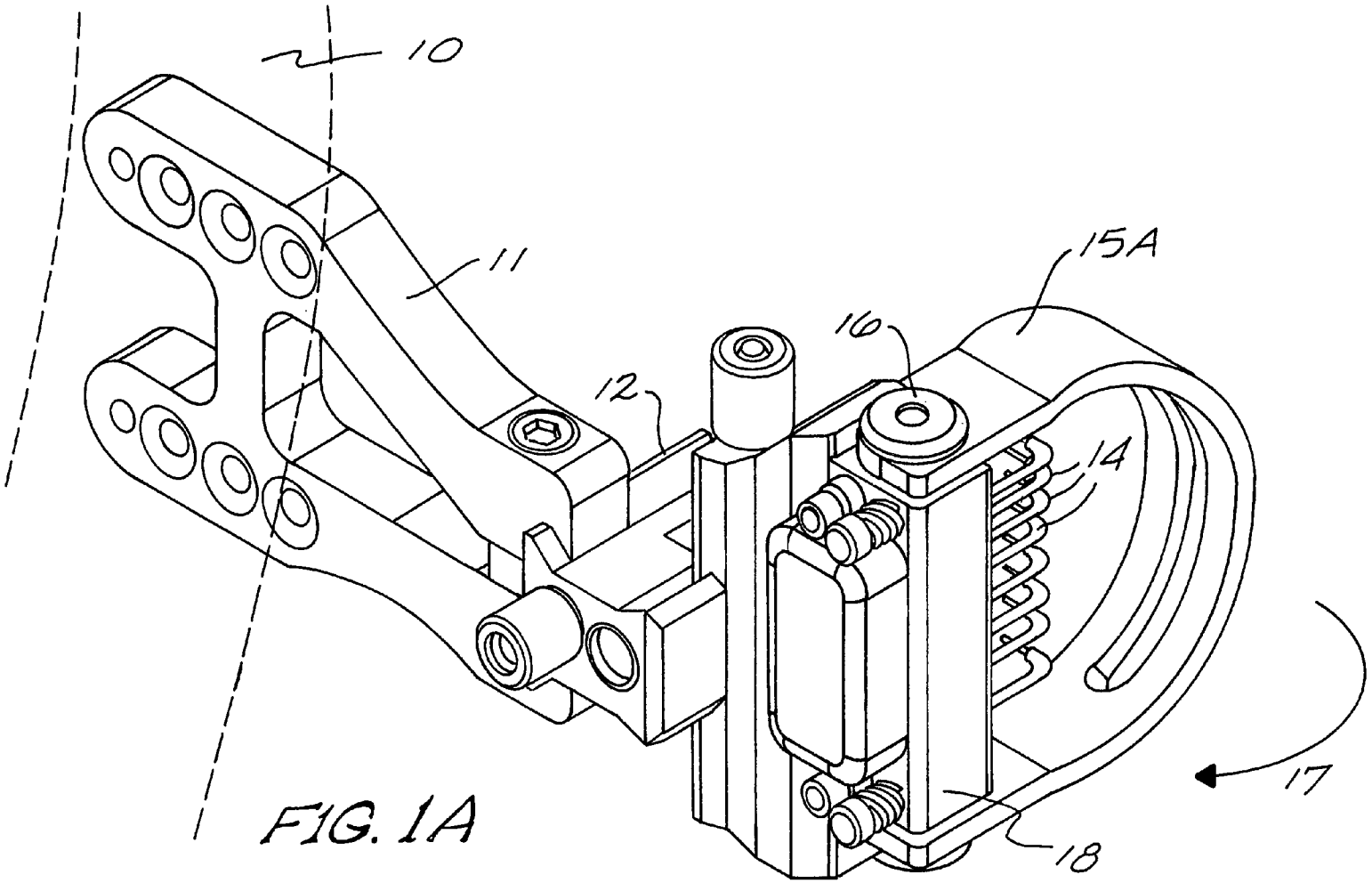
FIGS. 1A and 1B are perspective views of the preferred embodiment of the invention.
Figure 1B:
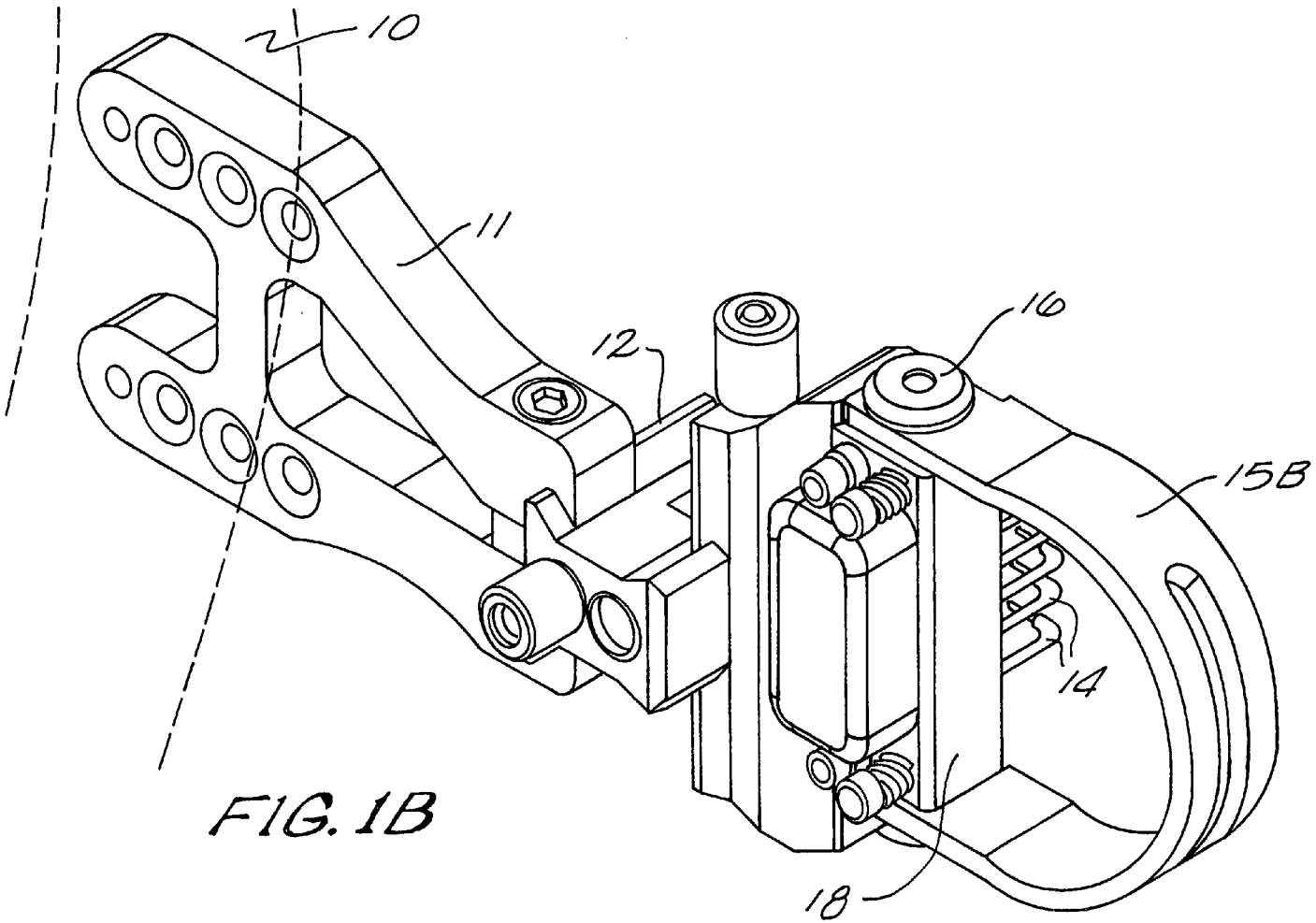

FIGS. 1A and 1B are perspective views of the preferred embodiment of the invention.

Referring FIG. 1A, the protective guard 15A is in a "locked" position. Note, the term "locked" refers to the condition of sighting pins 14. When protective guard 15A is in the position shown in FIG. 1A, sighting pins 14 cannot be removed and are fully secured to the frame which secures the assembly to bow 10.

In this embodiment, the frame is made up of an attachment mechanism 11 which is secured by slide 12 to pin lock mechanism 18. Sighting pins 14 are held in holes (not visible from this angle) within pin lock mechanism 18. Slide 12 provides for an additional adjustment of the entire grouping of sighting pins 14 to meet the needs of the archer.

Protective guard 15A is manually swiveled around mechanism 16 as indicated by arrow 17 to the "unlocked" position shown in FIG. 1B. "Unlocked" in this context means that sighting pins 14 can be removed from pin lock mechanism 18. It is the movement of protective guard 15A to the position shown in FIG. 1B that releases the pins from pin lock mechanism 18. Mechanism 16 provides a cam-like mechanism that engages the ends portions of pins 14 to provide the "locked"/"unlocked" condition.

In this manner, sighting pins 14 are either "locked" (FIG. 1A) or "unlocked" (FIG. 1B) as defined by the archer in the positioning of the protective guard (15A to 15B).

Figure 2:
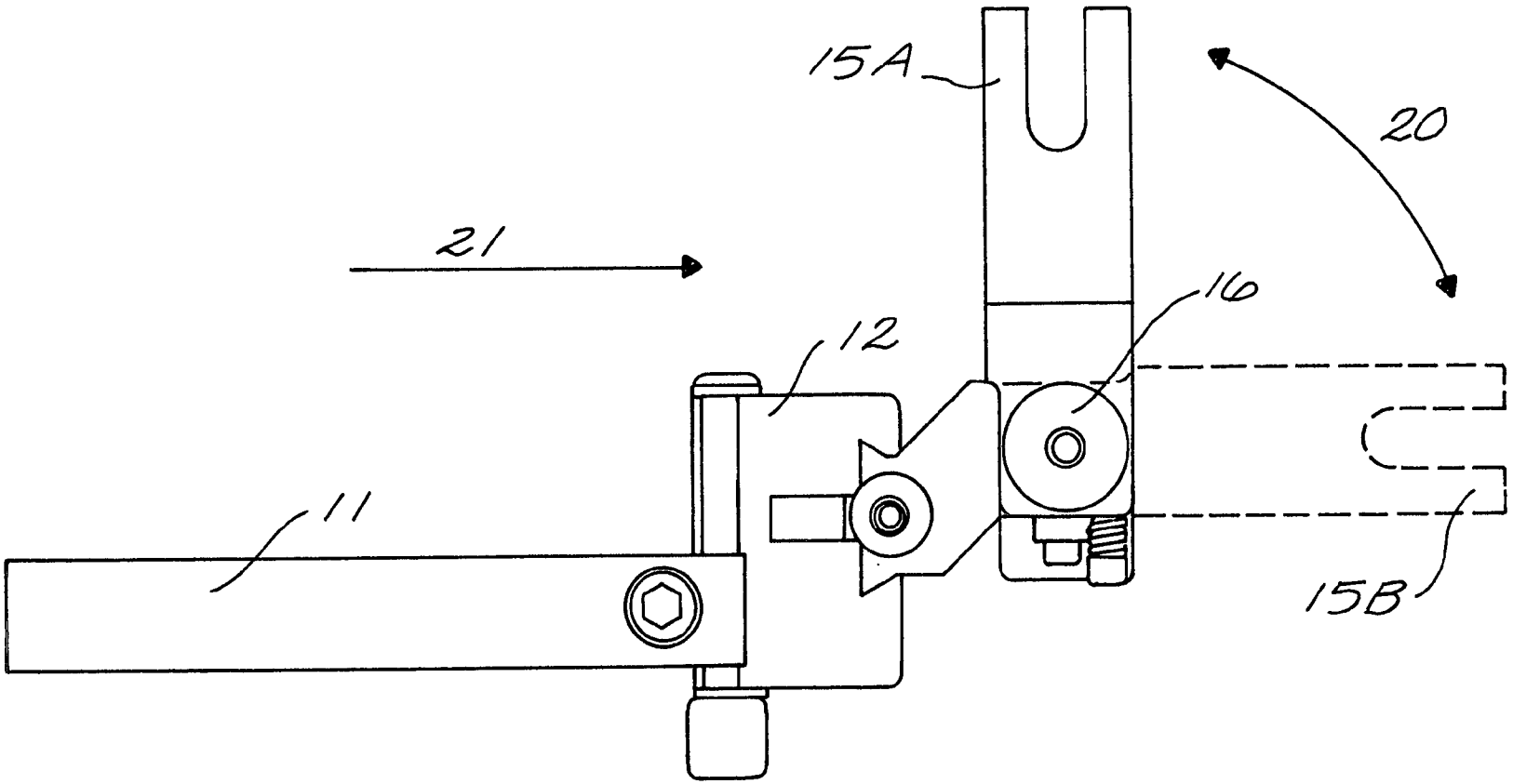
FIG. 2 is a top view of the preferred embodiment of the invention.

FIG. 2 is a top view of the preferred embodiment of the invention.

The archer's sighting line 21 extends through protective guard 15A. When protective guard 15A is perpendicular to the sighting line 21, the sighting pins (not visible from this angle) are "locked"; but when the protective guard is moved as indicated by arrow 20 to the position of protective guard 15B (now parallel to the sighting line 21) the sighting pins are now unlocked and are moveable by the archer.

This release/tightening of the sighting pins is accomplished by hinge 16 which serves as a cam to engage or not-engage the sighting pins.

Figure 3:
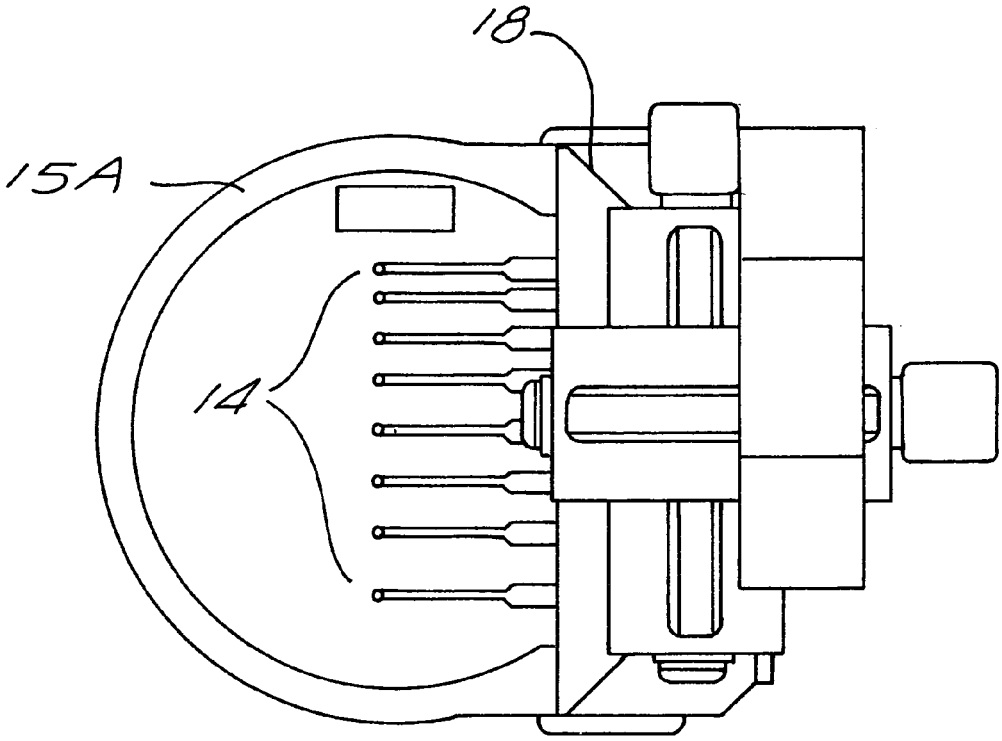
FIG. 3 is a front view of the preferred embodiment of the invention.

FIG. 3 is a frontal view of the preferred embodiment of the invention.

In this position, protective guard 15A has engaged or locked sighting pins 14 to the pin lock mechanism 18 allowing the archer to take "sight" through protective guard 15A.

It is clear that the present invention provides for a highly improved archery sight.

What is claimed is:

1. An archery bow sight comprising:

a) a sighting mechanism having, a brace secured to a bow, and, at least two sighting pins selectively secured to said brace and extending at right angles to an operator's line of sighting;

b) a protective guard secured to said brace; and, c) means for selectively moving said protective guard between, a first position perpendicular to a user's line of sighting and extending past said at least two sighting pins and wherein said at least two sighting pins are locked in position activated by the movement of the protective guard, and, a second position parallel with the operator's line of sighting wherein said at least two sighting pins are unlocked and removable activated by the movement of the protective guard.

2. The archery bow sight according to claim 1, further including a locking mechanism for securing said protective guard in said first position.

3. The archery bow sight according to claim 2,wherein when said locking mechanism is in said first position, said at least two sighting pins are secured to said brace.

4. The archery bow sight according to claim 3, wherein said locking mechanism further includes means for securing said protective guard at said second position.

5. An archery bow sight comprising:

a) a sighting mechanism having at least two sighting pins selectively secured to a brace;

b) a protective guard; and, c) means for selectively moving said protective guard between, a first position perpendicular to a user's line of sighting and extending past said at least two sighting pins, and, a second position parallel with the operator's line of sighting wherein said at least two sighting pins are removable from said brace activated by the movement of the protective guard.

6. The archery bow sight according to claim 5, further including a locking mechanism for securing said protective guard in said first position.

7. The archery bow sight according to claim 6, wherein when said locking mechanism is in said first position, said at least two sighting pins are secured to the archery bow sight.

8. The archery bow sight according to claim 7, wherein said locking mechanism further includes means for securing said protective guard at said second position.

9. An archery combination comprising:

a) an archery bow; and, b) a bow sight having, sighting mechanism having,

A) a brace secured to a bow, and,

B) at least two sighting pins selectively secured to said brace and extending at right angles to an operator's line of sighting, a protective guard secured to said brace, and, means for selectively moving said protective guard between, A) a first position perpendicular to a user's line of sighting and extending past said at least two sighting pins, and, B) a second position parallel with the operator's line of sighting and wherein said at least two sighting pins are removable from said brace activated by the movement of the protective guard.

10. The archery combination according to claim 9, further including a locking mechanism for securing said protective guard in said first position.

11. The archery combination according to claim 10, wherein when said locking mechanism is in said first position, said at least two sighting pins are secured to said brace.

* * * * *